United States Patent [19]

Schieferly et al.

[11] Patent Number: 4,952,168

[45] Date of Patent: Aug. 28, 1990

[54] COVER ASSEMBLY

[75] Inventors: Stephen B. Schieferly; Steven M. Weldon, both of Harrisburg, Pa.

[73] Assignee: AMP Incorporated, Harrisburg, Pa.

[21] Appl. No.: 463,045

[22] Filed: Jan. 11, 1990

[51] Int. Cl.[5] ..... H01R 13/58

[52] U.S. Cl. ..... 439/467; 439/519; 439/902

[58] Field of Search ..... 439/465–468, 439/473, 902, 906, 519

[56] References Cited

U.S. PATENT DOCUMENTS

| | | | |
|---|---|---|---|
| 4,421,376 | 12/1983 | Cosmos et al. | 439/461 |
| 4,549,780 | 10/1985 | Bertini et al. | 439/468 |
| 4,549,780 | 10/1985 | Bertini et al. | 339/107 |
| 4,561,715 | 12/1985 | Sanchez | 439/449 |
| 4,629,276 | 12/1986 | Genaro et al. | 439/449 |
| 4,722,580 | 2/1988 | Kocher et al. | 439/466 |
| 4,761,145 | 8/1988 | Goto et al. | 439/906 |

FOREIGN PATENT DOCUMENTS

| | | | |
|---|---|---|---|
| 1170327 | 7/1984 | Canada | 439/467 |
| 2013884 | 10/1971 | Fed. Rep. of Germany | 439/465 |

*Primary Examiner*—Gary F. Paumen

*Attorney, Agent, or Firm*—David L. Smith

[57] ABSTRACT

A cover assembly (20) for receiving a connector (56) terminated to a cable (92) is disclosed in which the cover assembly has a exterior contoured surface (118), a cavity (134) for receiving the connector and first (74) and second (76) cable exits from the cavity to the exterior contoured surface. Each cable exit is adapted to receive either the cable or a cable exit plug (28). The cable exit plug has first (120) and second (116) surfaces and is adapted to be received in the first cable exit (74) with the first surface (120), contoured to conform to the exterior surface of the housing surrounding the first cable exit, facing outwardly from the cavity. The cable exit plug is also adapted to be received in the second cable exit (76) with a second surface (116) facing outwardly from the cavity. The second surface is contoured to conform to the exterior surface of the housing surrounding the second cable exit.

7 Claims, 6 Drawing Sheets

COVER ASSEMBLY

BACKGROUND OF THE INVENTION

This invention relates to a connector cover assembly and in particular to a connector cover assembly adapted to receive a connector terminated to conductors of a cable with the cable passing through one of two angularly oriented cable exits and a cable exit plug disposed in the otherwise unused cable exit to provide a surface contoured and flush with the exterior of the connector cover assembly surrounding the cable exit plug.

There is disclosed in U.S. Pat. Nos. 4,722,580 and 4,629,276, cover and strain relief assemblies that provide multiple cable exit orientations. The cover assemblies disclosed have a single cable exit that, through securing various members in selected angular orientations relative to the connector, provide a plurality of cable exit directions.

U.S. Pat. No. 4,561,715 discloses a connector cover assembly that provides three cable exits, one each at 90 degrees, 180 degrees and 270 degrees. The cable passes through one of the cable exits; identical strain relief members are pressed into the other two cable exits.

SUMMARY OF THE INVENTION

In accordance with the present invention, a cover assembly for receiving a connector terminated to conductors of a cable has an exterior contoured surface, a cavity for receiving the connector, and first and second cable exits from the cavity to the exterior contoured surface. Each cable exit is adapted to receive either the cable or a cable exit plug. A cable exit plug having first and second surfaces, is adapted to be received in the first cable exit with the first surface facing outwardly from the cavity. The first surface is contoured to conform to the exterior surface of the housing surrounding the first cable exit. The cable exit plug is also adapted to be received in the second cable exit with a second surface facing outwardly from the cavity. The second surface is contoured to conform to the exterior surface of the housing surrounding the second cable exit.

DESCRIPTION OF THE PREFERRED EMBODIMENT

Figure 1:
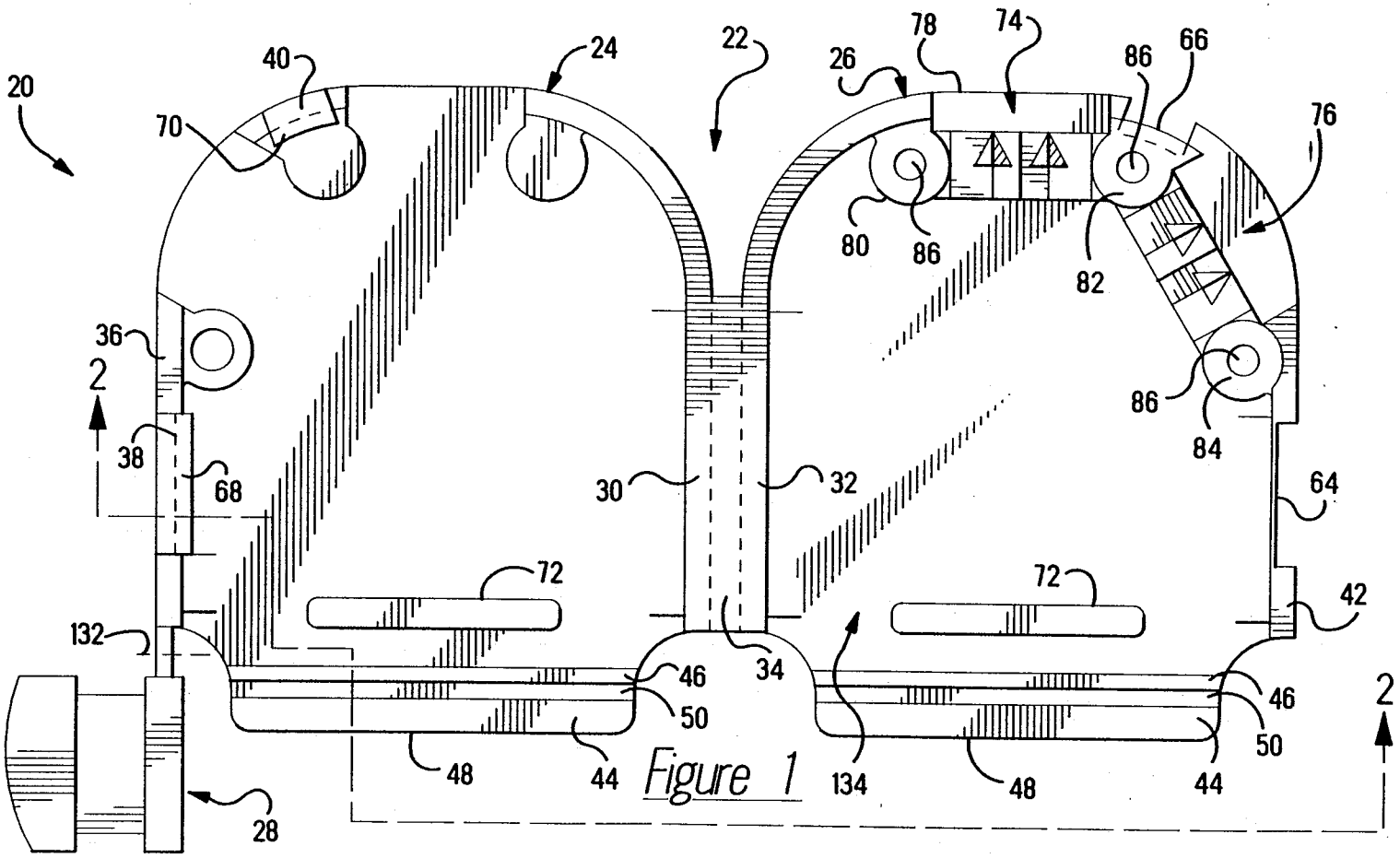
FIG. 1 is a top view of the cover of the present invention, having the dual surface cable exit plug detachably molded thereon.

Cover assembly 20 in accordance with the present invention is shown in FIG. 1. Cover assembly 20 is comprised of cover 22, itself comprised of cover members 24 and 26, and cable exit plug 28. Cover members 24,26 in the preferred embodiment are joined along common side walls 30,32 by web 34 which functions as a hinge. Cover member 24 has extending from the opposed side wall 36, latch means 38,40 for detachably securing the cover members 24,26 together along side walls 36,42 or alternatively the rear wall when cover member 24 is folded, along web 34, over cover member 26. Other known means of securing the two cover members may be employed.

Figure 9:
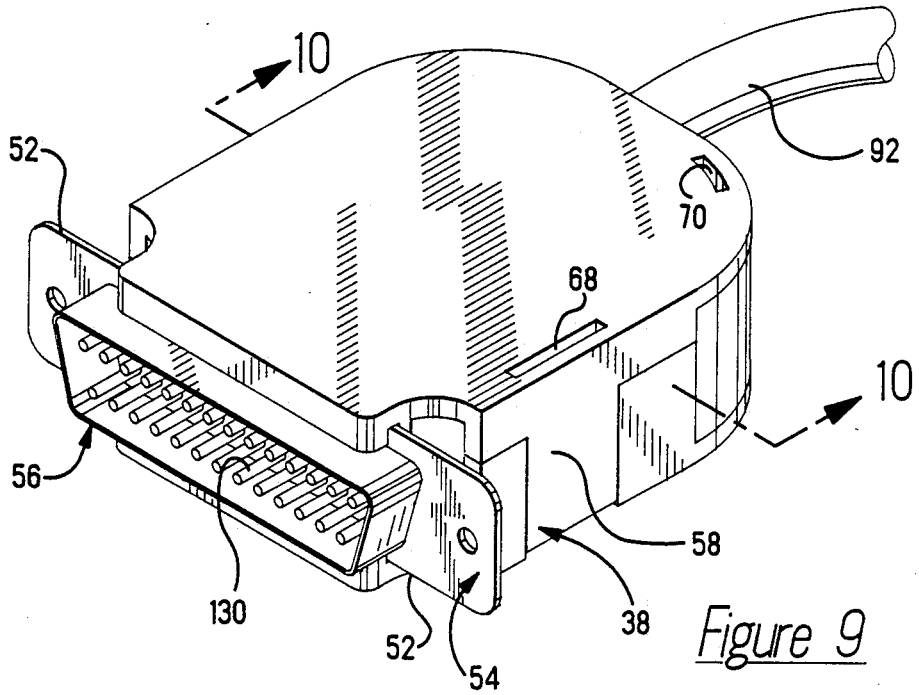
FIG. 9 shows a connector, terminated to conductors of a cable, received in the cavity of the cover with the cable passing through the 180 degree cable exit.

In a preferred embodiment, cover member 22 is molded of an insulative material and has a cable exit plug 28 detachably molded thereto. Each cover member 24,26 has spaced transverse ribs 44,46 along forward face 48 defining flange receiving groove 50 therebetween. Flange receiving groove 50 receives the periphery 52 of flange 54 of connector 56 (see FIG. 9) therein.

Figure 2:
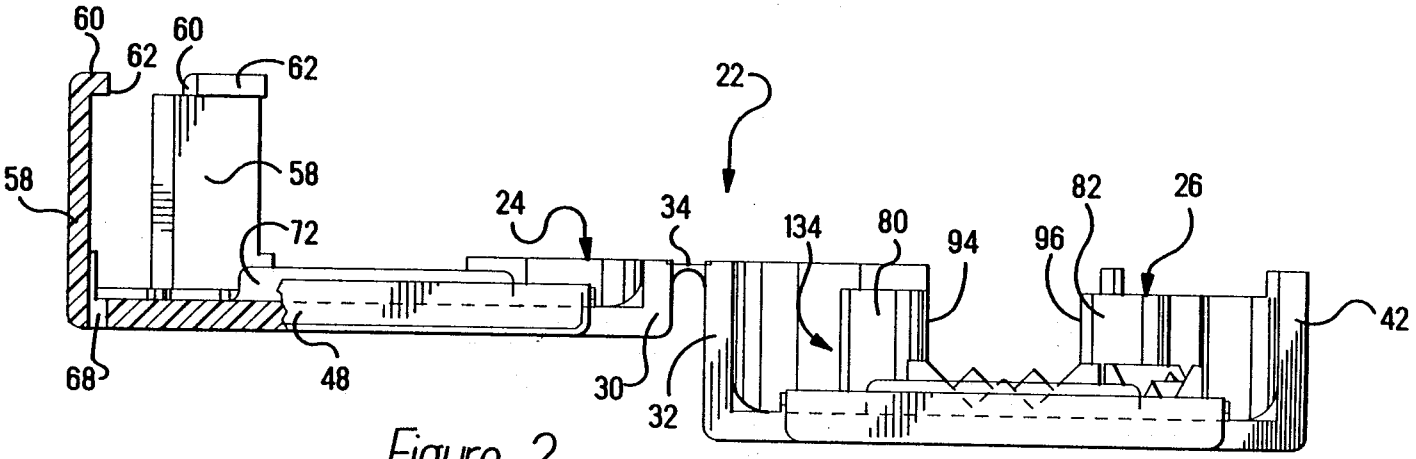
FIG. 2 is a front view of the cover taken along line 2—2 in FIG. 1.

Latch means 38,40 include, as best seen in FIG. 2, an arm 58 extending beyond side wall 36 and a transverse member 60. As cover member 24 is folded over cover member 26 the inwardly facing edge 62 of transverse member 60 of latch means 38,40 engages and slides along recessed surface 64,66 respectively causing arms 58 to flex outwardly until transverse members 60 pass over retention shoulders (not shown) thence permitting arms 58 to resile inwardly thereby latchingly releasably securing the cover members together. Adjacent each latch member 38,40 and cover member 24 is a latch release aperture 68,70 for receiving tooling (not shown) to press arms 58 outwardly thereby permitting transverse member 60 to pass retention shoulders as cover member 24 is rotated away from cover member 26. Transverse ribs 72 are spaced rearwardly from ribs 44 and 46 and are provided to engage and position the rear portion of connector 56. Cover member 26 has two cable exits 74,76. Cable exit 74 is straight out through rear wall 78 and is said to be at 180 degrees. Cable exit 76 passes through the contoured transition between rear wall 78 and side wall 42 and, in the preferred embodiment, is at 120 degrees. In a typical application, a cable will pass through one of the two cable exits and the other cable exit will be closed off with cable exit plug 28.

Figure 10:
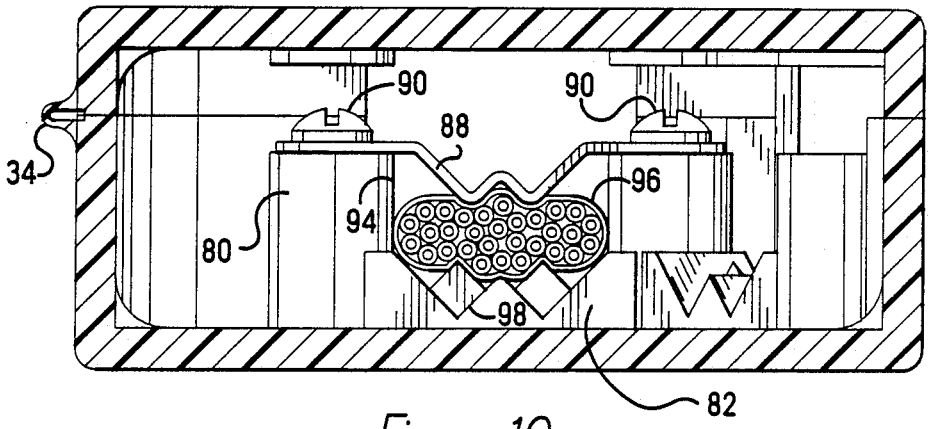
FIG. 10 is a cross section of the cover taken along the lines 10—10 in FIG. 9 showing a strain relief clamp for the cable passing through the 180 degree cable exit.
Figure 11:
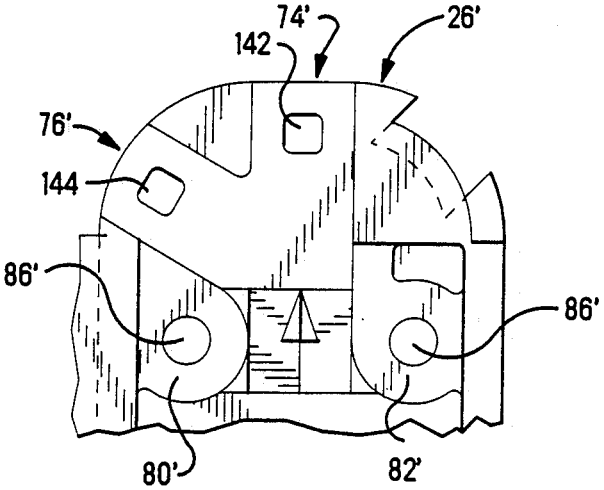
FIG. 11 is a partial, top view of an alternate embodiment cover.

In a preferred embodiment, cable exit 74 has a pair of spaced screw posts 80,82 adjacent thereto. Cable exit 76 also has a pair of screw posts 82,84 adjacent thereto and spaced substantially as posts 80 and 82 are spaced. In this embodiment, screw post 82 will be used with both cable exits. Each screw post has an unthreaded bore 86 therein. The spacing between sCrew posts 80 and 82 being substantially the same as the spacing between screw posts 82 and 84 permits the same strain relief clamp 88 (see FIG. 10) to be used regardless of which cable exit, 74 or 76, is selected for the cable. Strain relief clamp 88 is resilient and is secured in place by screws 90 passing through apertures (not shown) and being threadingly secured in bores 86 of the appropriate screw posts. Clamp 88 compresses cable 92 against cable exit walls 94 and 96, which may be formed by the adjacent screw posts, as well as between itself and undulations 98 to provide strain relief to the cable conductor-to-contact terminations. Clamp 88 provides strain relief to the conductor-to-contact terminations for a smaller cable in the orientation shown in FIG. 10, and a larger cable (not shown) when inverted.

Figure 7:
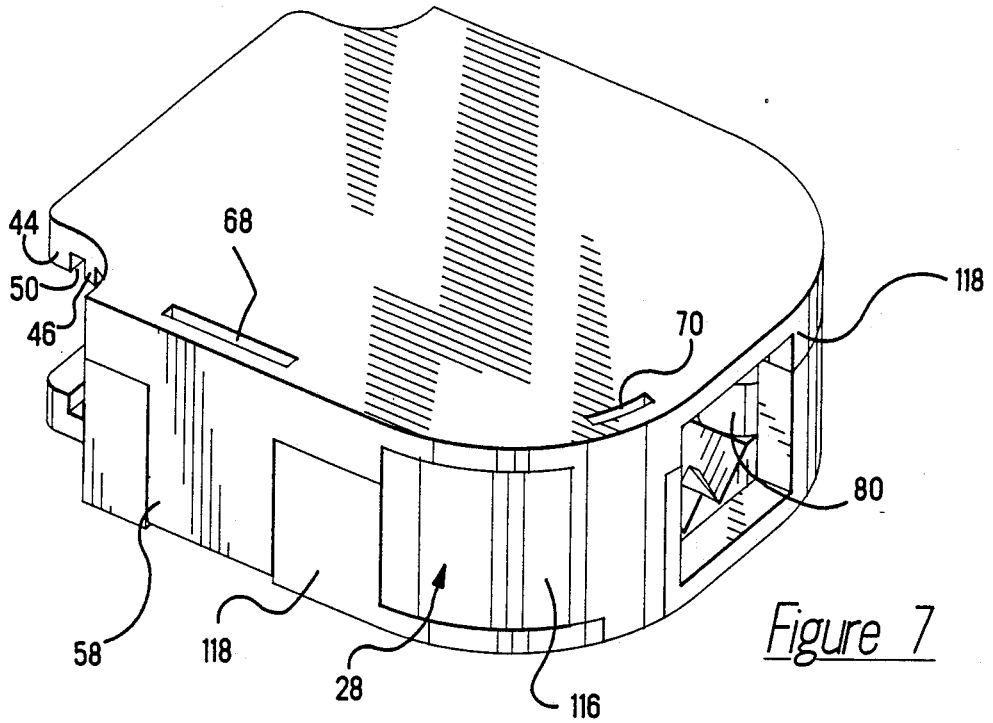
FIG. 7 is a rear perspective view of the closed cover with the cable exit plug disposed in the 120 degree cable exit.
Figure 8:
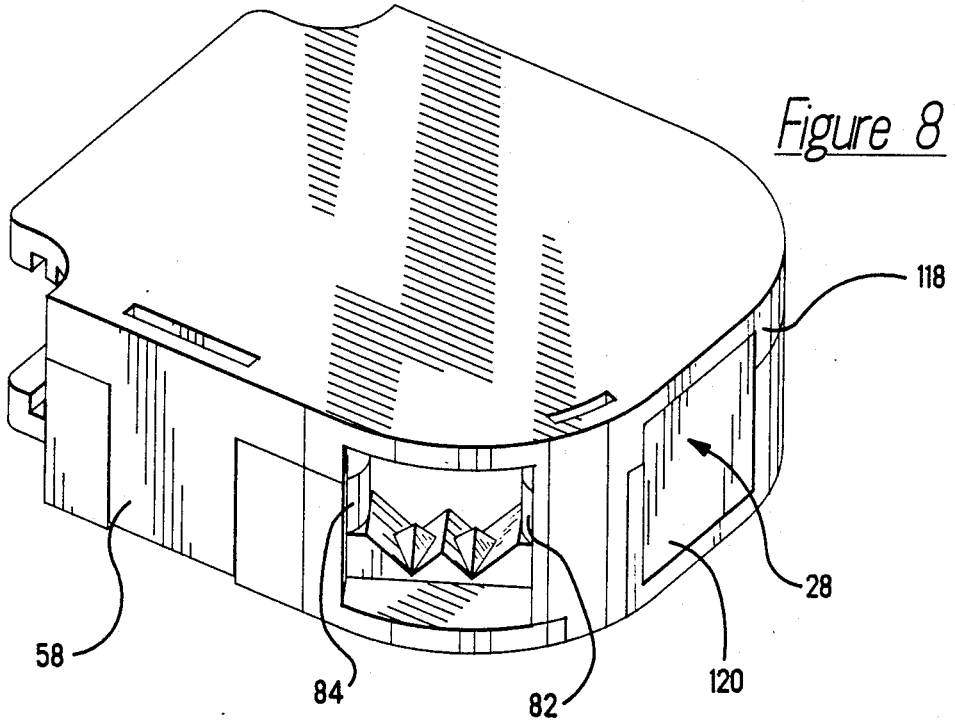
FIG. 8 is a rear perspective view of the closed cover with the cable exit plug disposed in the 180 degree cable exit.

Cable exit plug 28 has a first end 110, a second end 112 and a reduced cross-section mid-section 114 therebetween. Cable exit plug 28 is shown from two perspectives in the views of FIGS. 3 and 4, from top views in cable exits 76 and 74 in FIGS. 5 and 6, respectively, and from an exterior view positioned in cable exit 76 and 74 with cover member 24 latchingly secured to cover member 26 in FIGS. 7 and 8.

Figure 3:
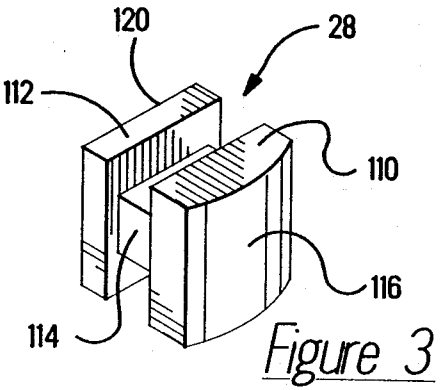
FIG. 3 is a perspective view of the cable exit plug shown in FIG. 1, from a first major surface.
Figure 4:
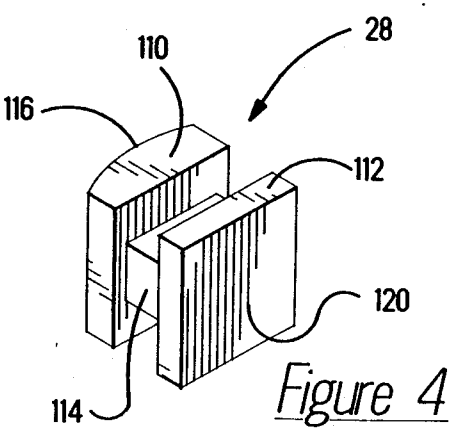
FIG. 4 is a perspective view of the cable exit plug shown in FIG. 1, from a second major surface.
Figure 5:
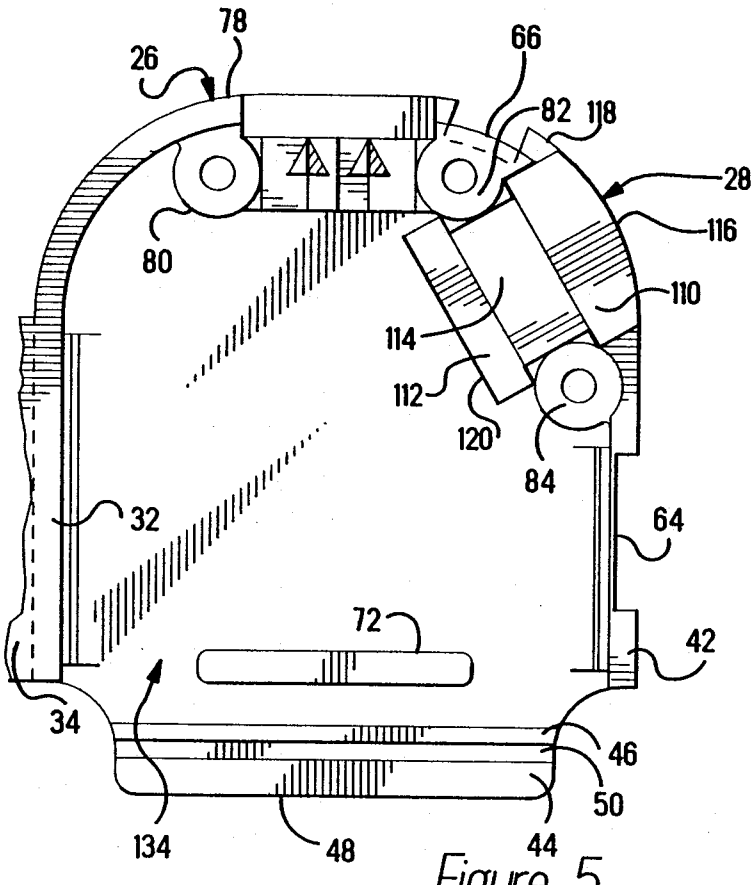
FIG. 5 is a top view of the right side of the cover as shown in FIG. 1, with the 180 degree cable exit available to receive a cable and the cable exit plug disposed in the 120 degree cable exit.

As seen in FIGS. 3 and 4, first end 110 of plug 28 has a curved exterior surface 116. Surface 116 is contoured to conform to the exterior surface 118 of cover 22 surrounding cable exit 76 when plug 28 is positioned in cable exit 76 with surface 116 facing outwardly and the cover members latchingly secured together. This is best seen in FIG. 5 as surface 116 is flush with and blends into side wall 42 and rear wall 78 substantially replicating a mirror image of the exterior surface 118 of the transition between side wall 32 and rear wall 78. The view of FIG. 7 also shows how exterior surface 116 is contoured to conform to exterior surface 118 surrounding cable exit 76.

Figure 6:
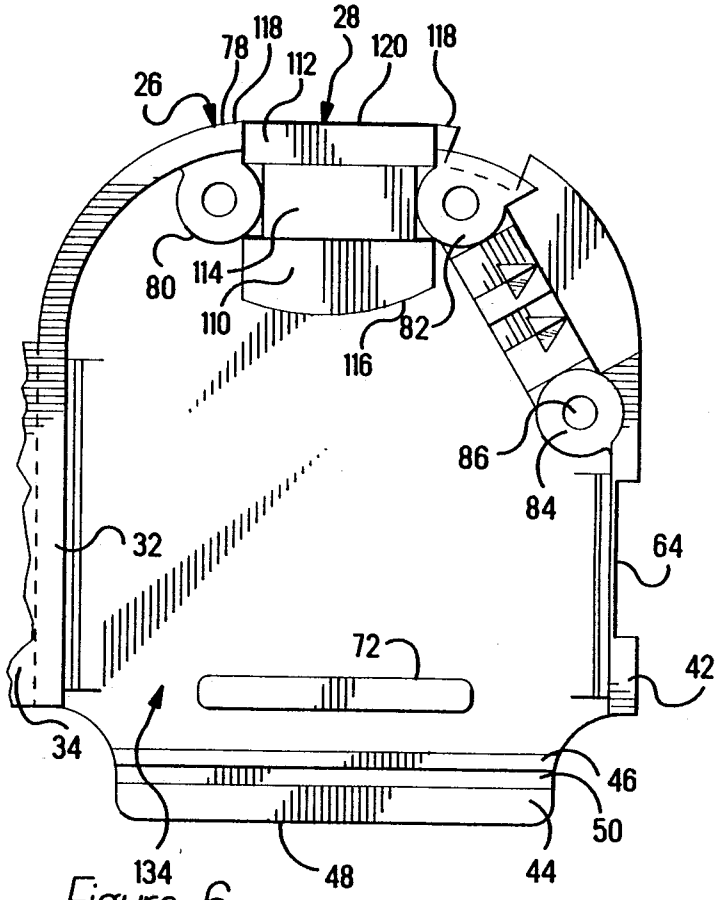
FIG. 6 is a top view of the right side of the cover as shown in FIG. 1, with the 120 degree cable exit available to receive a cable and the cable exit plug disposed in the 180 degree cable exit.

Second end 112 in the preferred embodiment has a flat exterior surface 120 that conforms to the exterior surface 118 of cover 22 surrounding cable exit 74 when plug 28 is positioned in cable exit 74 with surface 120 facing outwardly and the cover members latchingly secured together. This is best seen in FIG. 6 as surface 120 is flush with and blends into exterior surface 118 of rear wall 78. The view of FIG. 8 also shows how exterior surface 120 is contoured to conform to exterior surface 118 surrounding cable exit 74.

Cover 22 has means for securing plug 28 in cable exit 74 or 76 not occupied by cable 92. As best seen in FIGS. 5 and 6 plug 28 cooperates with the screw posts adjacent the cable exit in which plug 28 is received to position plug 28 in the cable exit such that the exterior surface of plug 28 is flush with the exterior surface 118 of cover 22 surrounding the cable exit in which plug 28 is received and to provide means to secure plug 28 in the cable exit of cover 22. Mid-section 114 is received between the screw posts adjacent to the cable exit in which plug 28 is disposed with screw posts 28 providing spaced ribs or guides to prevent lateral movement of plug 28. The mid-section acts as a channel to receive the adjacent screw posts. Both first end 110 and second end 112 engage the adjacent screw posts to secure plug 28 in the selected cable exit and to prevent substantial movement of plug 28 therein.

Figure 12:
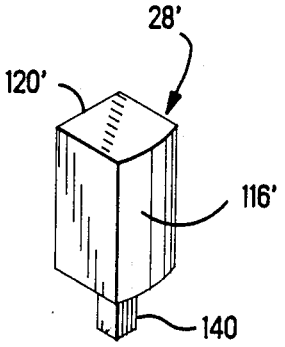
FIG. 12 is a perspective view of an alternate embodiment cable exit plug.
Figure 13:
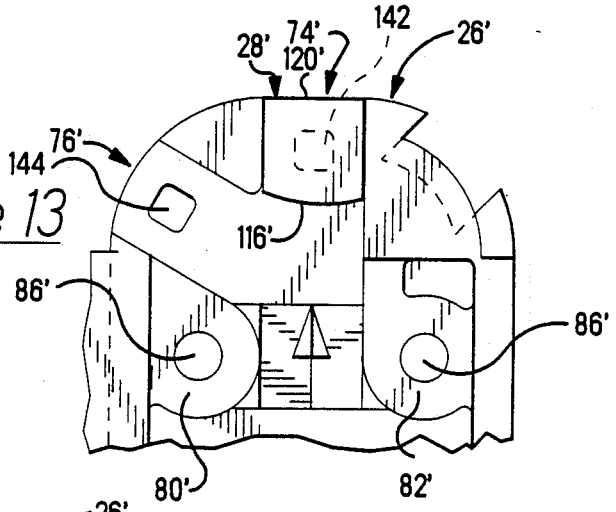
FIG. 13 is the alternate embodiment cover member of FIG. 11 with the alternate embodiment cable exit plug of FIG. 12 disposed in the 180 degree cable exit.
Figure 14:
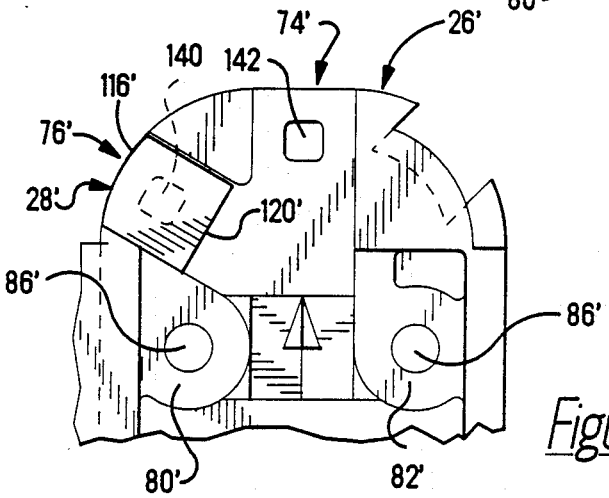
FIG. 14 is the alternate embodiment cover member of FIG. 11 with the alternate embodiment cable exit plug of FIG. 12 disposed in the 120 degree cable exit.

In an alternate embodiment shown in FIGS. 11 through 14, a single pair of screw posts 82',84' support a cable clamp (not shown) for providing strain relief to a cable as described above. An alternate embodiment cable exit plug 28', as seen in FIGS. 12 and 14, has a curved exterior surface 116' contoured to conform to the exterior surface 118' of cover 22' surrounding cable exit 76' when plug 28' is positioned in cable exit 76' with surface 116' facing outwardly and the cover members are latchingly secured together, similar to surface 116 of plug 28 and surface 118 as described above. As best seen in FIGS. 12 and 13, flat exterior surface 120' of plug 28' conforms to the exterior surface 118' of cover 22 surrounding cable exit 74' when plug 28 is positioned in cable exit 74' with surface 120' facing outwardly and the cover members are latchingly secured together, similar to surface 120 of plug 28 and surface 118 as described above.

Cable exit plug 28' has means for securing the plug in the cable exit of the cover. Plug 28' has a protrusion 140 on a surface thereof adapted to be received in recess 142 in cover 22 When plug 28' is received in cable exit 74', and protrusion 140 is adapted to be received in recess 144 when plug 28' is received in cable exit 76, The protrusion and recess cooperate to secure plug 28 in the selected cable exit and to prevent plug 28 from moving inwardly toward cavity 134 or outwardly toward exterior surface 118'. Plug 28' could have protrusions on opposed surfaces adapted to be received in complementary recesses in the cover. Alternatively plug 28' could have one or more recesses adapted to fit over protrusions in the cable exit of the cover. The cable exit plug securing means position and secure plug 28' in the selected cable exit, 74' or 76', with the exterior surface of plug 28' flush with the exterior surface of the cover when the cover members are latchingly secured together.

Plug 28 is adapted to be received in either cable exit 74 or 76, with a first surface of plug 28 being the exterior surface in cable exit 74 and conforming to the exterior surface 118 of cover 22 surrounding exit 74 and with a second surface of plug 28 being the exterior surface when plug 28 is received in cable exit 76 with the second surface conforming to the exterior surface 118 of cover 22 surrounding exit 76. With plug 28 in cable exit 74, surface 120 faces outwardly and surface 116 faces inwardly. With plug 28 in cable exit 76, surface 116 faces outwardly and surface 120 faces inwardly. When cover member 24 is latchingly secured to cover member 26 with plug 28 in either cable exit, plug 28 cannot be removed from that cable exit.

Subsequent to termination of cable conductors to contacts 130 in connector 56, connector 56 is positioned in cavity 134 of cover member 26 with a portion of the periphery of flange 54 received in groove 50. A cable exit is selected and the cable routed through the selected cable exit. Strain relief clamp 88 is positioned over the cable and secured to the adjacent screw posts to provide strain relief. Cable exit plug 28 is detached from cover 22, such as by severing along dotted line 132, (see FIG. 1), oriented with the appropriate exterior surface 116 or 120 facing outwardly and positioned in the otherwise unused cable exit that was not selected to receive the cable. Cover member 24 is folded over cover member 26 thereby defining cavity 134 in which the back end of the connector, the terminations, and a portion of the cable reside. As cover member 24 moves toward its secured position, another portion of the periphery of flange 54 is received in groove 50 of cover member 24. In the secured position of cover member 24, grooves 50 are substantially parallel and cover members 24 and 26 are releasably latchingly secured together.

We claim:

1. A cover assembly for receiving a connector terminated to conductors of a cable, the cover assembly comprising:

latchable cover means having an exterior contoured surface, a cavity for receiving the connector and first and second cable exits from the cavity to the exterior contoured surface, each cable exit adapted to receive either the cable or a cable exit plug; and a cable exit plug, said cable exit plug having first and second surfaces, said cable exit plug adapted to be received in the first cable exit with said first surface facing outwardly from said cavity, said first surface contoured to conform to the exterior surface of the cover means surrounding the first cable exit, said cable exit plug adapted to be received in said second cable exit with said second surface facing outwardly from said cavity, said second surface contoured to conform to the exterior surface of the cover means surrounding the second cable exit, whereby when a connector terminated to conductors of a cable is received in the cover means and the cable is passed out through a selected one of the cable exits, the cable exit plug is adapted to be positioned in the other cable exit.

2. A cover assembly as recited in claim 1, wherein the cover means is molded and the cable exit plug is molded as a detachable part of the cover means.

3. A cover assembly as recited in claim 1, wherein the cover means is comprised of two cover members, said cover members being hinged along a common edge thereof.

4. A cover assembly as recited in claim 1, further comprising means securable to the cover means adapted for providing strain relief to the cable.

5. A cover assembly as recited in claim 1, further comprising means for securing the cable exit plug in the cover means.

6. A cover assembly as recited in claim 5, wherein the securing means comprise a protrusion on said cable exit plug and a recess in said selected one of the cable exits, the protrusion adapted to be received in the recess and to cooperate therewith to position and secure the cable exit plug in said selected one of said cable exits.

7. A cover assembly as recited in claim 5, wherein the cable exit plug has a reduced cross section portion, and wherein the securing means comprise spaced guide means adapted to receive the reduced cross section portion of the cable exit plug to secure the cable exit plug in the cover means.

* * * * *